US005577370A

United States Patent [19]

Pajak et al.

[11] Patent Number: 5,577,370

[45] Date of Patent: Nov. 26, 1996

[54] APPARATUS FOR SEALING A CONTAINER

[75] Inventors: Bernard W. Pajak, Princeton; Richard A. Kennedy, Basking Ridge; Paul K. Bowers, Ledgewood, all of N.J.

[73] Assignee: The Pillsbury Company, Minneapolis, Minn.

[21] Appl. No.: 503,193

[22] Filed: Jul. 17, 1995

Related U.S. Application Data

[63] Continuation of Ser. No. 206,732, Mar. 7, 1994.

[51] Int. Cl.[6] ..... B65B 51/10; B65B 7/28

[52] U.S. Cl. ..... 53/478; 53/330; 53/329.3

[58] Field of Search ..... 53/329.2, 329.3, 53/329.5, 330, 297, 478, 319, 320, 559, 489

[56] References Cited

U.S. PATENT DOCUMENTS

| | | | |
|---|---|---|---|
| 1,514,379 | 11/1924 | Fleischer . | |
| 2,353,582 | 7/1944 | Pearson | 229/45 |
| 2,433,926 | 1/1948 | Sayre | 229/1.5 |
| 2,712,893 | 7/1955 | Charland | 53/319 |
| 2,965,499 | 12/1960 | Wise | 99/180 |
| 3,060,652 | 10/1962 | Eckman | 53/478 |
| 3,116,153 | 12/1963 | Seiferth et al. | 99/171 |
| 3,506,458 | 4/1970 | Parlour | 99/172 |
| 3,550,805 | 12/1970 | Leonforte | 220/42 |
| 3,624,787 | 11/1971 | Newman | 220/60 |
| 3,628,301 | 12/1971 | Vermeulen | 53/329.3 |
| 3,666,088 | 5/1972 | Wingardh | 206/46 |
| 3,783,089 | 1/1974 | Hurst et al. | 53/478 |
| 3,792,566 | 2/1974 | Kenney | 53/329.2 |
| 3,916,602 | 11/1975 | Doty | 53/329.3 |
| 4,035,987 | 7/1977 | Nakazato et al. | 53/329.3 |
| 4,233,325 | 11/1980 | Slangan | 426/107 |
| 4,362,002 | 12/1982 | Rowland et al. | 53/297 |
| 4,444,795 | 4/1984 | Weinstein | 426/90 |
| 4,625,498 | 12/1986 | Parsons | 53/526 |
| 4,627,550 | 12/1986 | Dines | 220/306 |
| 4,640,733 | 2/1987 | Bogren | 53/489 |
| 4,724,654 | 2/1988 | Dahlin et al. | 53/330 |
| 4,874,618 | 10/1989 | Seaborne et al. | 426/76 |
| 4,888,935 | 12/1989 | Wythoff | 53/478 |
| 4,923,702 | 5/1990 | Powell et al. | 426/115 |
| 4,982,555 | 1/1991 | Ingemann | 53/405 |
| 4,989,394 | 2/1991 | Berg et al. | 53/330 |
| 5,182,896 | 2/1993 | Maccherone | 53/478 |
| 5,251,758 | 10/1993 | Kolacek | 206/542 |

FOREIGN PATENT DOCUMENTS

| | | |
|---|---|---|
| 0039660A1 | 11/1981 | European Pat. Off. . |
| 2267930 | 11/1975 | France . |
| WO84/04507 | 11/1984 | WIPO . |

*Primary Examiner*—Lowell A. Larson
*Assistant Examiner*—Rodney Butler
*Attorney, Agent, or Firm*—Westman, Champlin & Kelly, P.A.

[57] ABSTRACT

A food container includes a recessed film membrane which seals the container. The recessed film membrane is applied with an apparatus which includes a container holder and a film membrane applicator. The film membrane applicator applies the film membrane to the container and seals the film membrane to the container. The applicator includes a sealing head which places the film membrane into the container. The sealing head seals an edge of the film membrane to an inner wall of the container using heat. The film membrane is moved through the applicator and cut. The sealing head includes two lips to provide a double seal between the film membrane and the inner wall of the container.

8 Claims, 7 Drawing Sheets

30
32
12
18
44
44
14
50
22
34
20
29
26
36
38
28
24
16
10

APPARATUS FOR SEALING A CONTAINER

This is a continuation of application Ser. No. 08/206,732, filed Mar. 7, 1994.

BACKGROUND OF THE INVENTION

The present invention relates to a food container. More specifically, the present invention relates to an apparatus for adhering a seal to a food container.

Seals for sealing food containers are known. U.S. Pat. No. 5,251,758 issued Oct. 12, 1993 to Kolacek entitled FOOD CONTAINER WITH GRIPPABLE PORTION HAVING SENSE OF TOUCH INDICA shows an example of a food-containing cup having a seal. In distributing food to consumers, it is necessary to provide a container with a hermetic seal. The container should be compact and easy to produce and distribute. A cup formed of cardboard is an example of a container which is typically used to contain food products, such as ice cream. The cardboard cup must be hermetically sealed. The seal should be easy for the consumer to remove. Further, it is desirable to provide a seal which shows evidence of tampering.

Various types of devices for applying a seal to a container are known. For example, U.S. Pat. No. 4,625,498, issued Dec. 2, 1986, shows a device for sealing a container with a film seal.

There is a continuing need for apparatus used to seal food containers.

SUMMARY OF THE INVENTION

A food container is provided with a recessed film membrane which seals the container. The membrane is recessed in the container and sealed along an inner wall of the container. The film membrane is applied with an apparatus including a container-holding section and a membrane applicator. The membrane applicator includes a sealing head which places the membrane into the container. An outer rim of the sealing head bonds the membrane to the inner wall of the container.

DETAILED DESCRIPTION OF THE PREFERRED EMBODIMENTS

Figure 1:
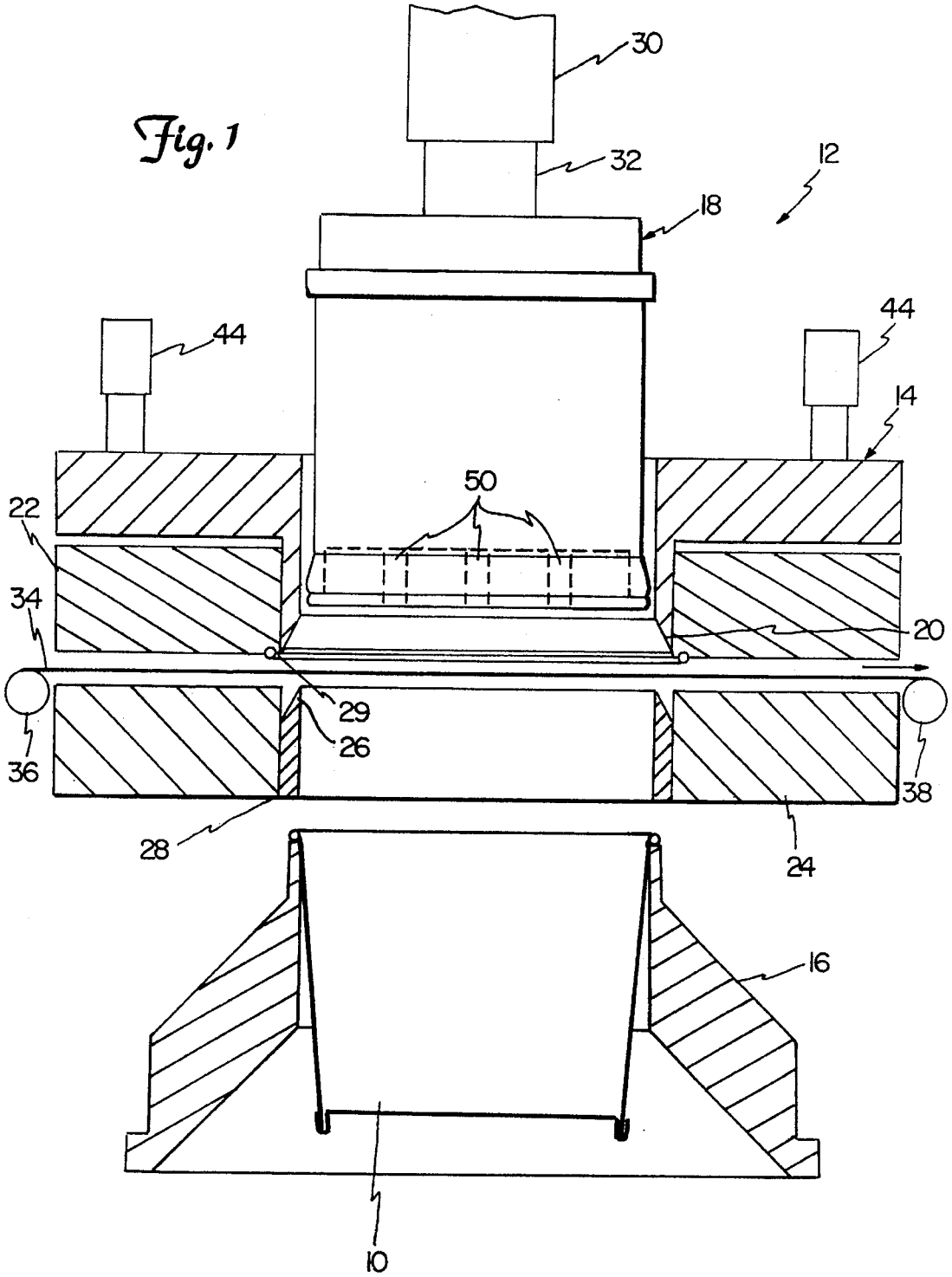
FIG. 1 is a cross-sectional view of a container and film membrane application in accordance with the present invention.

FIG. 1 is a cross-sectional view of a cup (container) 10 and film depositing apparatus 12. Depositing apparatus 12 includes a film membrane applicator 14 and cup holder 16.

Cup 10 is a container for containing food. In a preferred embodiment, cup 10 is used to contain ice cream, however, cup 10 can be used to contain other foods such as yogurt, dairy and non-dairy products, both frozen and non-frozen.

A film membrane seal is used to seal the top of cup 10. The film membrane is recessed within cup 10 leaving headroom between the seal and the top of the cup. FIGS. 1–4 show a sequence of steps performed by apparatus 12 to apply a film membrane seal to cup 10.

Membrane applicator 14 includes sealing head 18, upper knife 20, upper membrane clamp 22, lower membrane clamp 24, holding ring 26 and retaining ring 28. O-ring 29 is carried on upper membrane clamp 22.

Seal head 18 fits in an opening through upper knife 20, upper membrane clamp 22, lower membrane clamp 24, holding ring 26 and retaining ring 28 and into the top opening of cup 10. Sealing head 18 is coupled to drive element 30 through drive rod 32. Drive element 30 may comprise, for example, a piston assembly for urging sealing head 18 downward into cup 10.

As shown in FIG. 1, a space is provided between upper membrane clamp 22 and lower membrane clamp 24 through which membrane film 34 is drawn. Membrane film 34 is a web which is carried on rollers 36 and 38 and pulled through applicator 14 in the direction shown by the arrow.

In operation, film membrane 34 is moved into position by rollers 36 and 38. Sealing head 18 is urged downward into cup 10 to seal film from membrane 34 to the interior of cup 10. Membrane film 34 is cut with upper knife 20 and holding ring 26. The diameter of cup 10 is smaller than the diameter of membrane 34 cut by knife 20 and holding ring 26. The cut membrane 34 is identified as 34*a*. Holder 26 prevents membrane 34*a* from curling after cutting. Film 34*a* is picked up by head 18 as head 18 moves downward. The diameter of head 18 is also smaller than the diameter of cut membrane 34*a*. The excess portion of membrane 34*a* extending beyond the edges of head 18 wraps around the sides of sealing head 18 and is sealed to the inner wall of cup 10.

Figure 2:
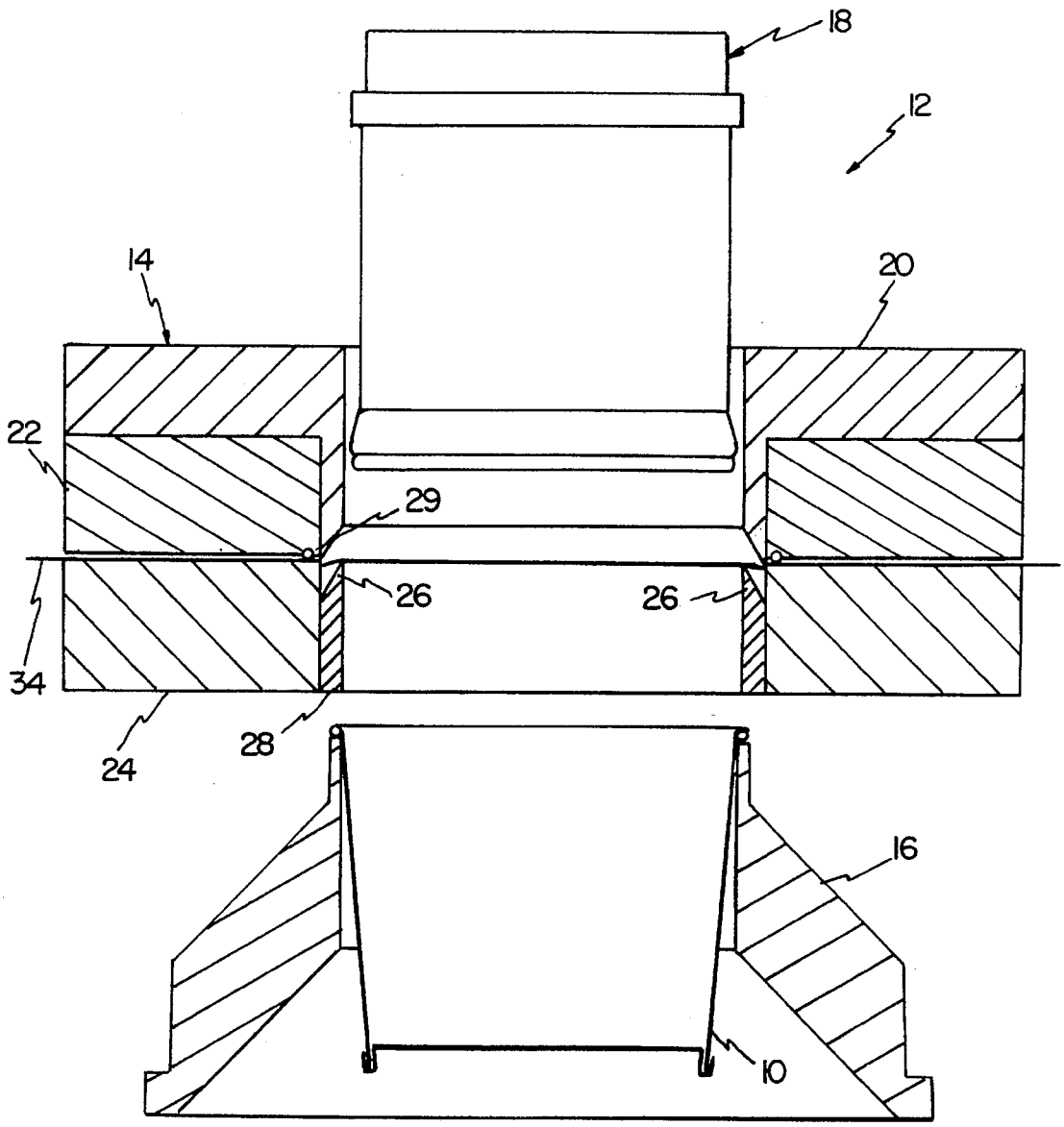
FIG. 2 is a cross-sectional view of the apparatus of FIG. 1 showing a subsequent step in the membrane application process.

FIG. 2 is similar to FIG. 1 and shows a subsequent step in the operation of apparatus 12 during application of membrane 34*a* to cup 10. For simplicity, FIGS. 2–4 do not show the rollers and drive mechanism shown in FIG. 1. FIG. 2 shows membrane film 34 just prior to cutting by upper knife 20 and holding ring 26. Film 34 is held by upper membrane clamp 22 and lower membrane clamp 24. Clamps 22 and 24 and knife 20 and holding ring 26 are pushed together by drive elements 30 and 44. O-ring 29 presses against film 34 and holds film 34 in place while it is cut by upper knife 20 and holding ring 26.

Following the cutting of film 34 by upper knife 20 and holding ring 26, sealing head 18 is pushed downward by drive element 30 and drive rod 32 through retaining ring 28 and into cup 10. In a preferred embodiment, membrane 34 comprises product number E.16978.93 which is available from American National Can of Minneapolis, Minnesota. Membrane 34 has a strong shape memory and tends to return to its original shape, a roll. Sealing head 18 is rapidly forced downward thereby preventing membrane 34 from curling back into its original shape. Further, retaining ring 28 provides an outer circumference through which head 18 travels and causes the outer edge of cut membrane 34*a* to form a lip (not shown in FIG. 2) around the outer circumference of head 18. This lip is sealed against the inner wall of cup 10 in a subsequent step.

Figure 3:
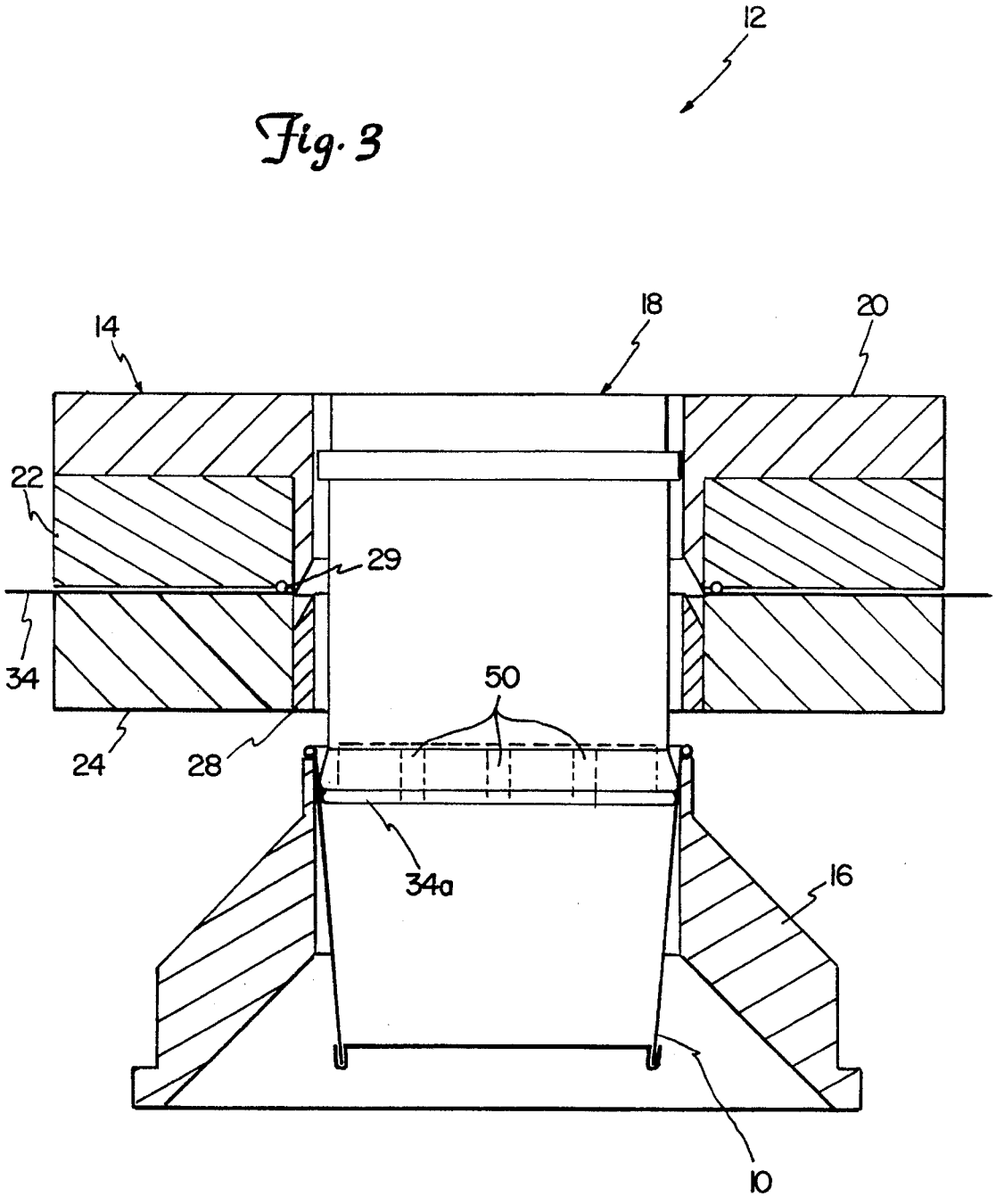
FIG. 3 is a cross-sectional view of the apparatus of FIG. 1 showing a subsequent step in the membrane application process.

FIG. 3 shows sealing head 18 in its extended most position in which the rim of head 18 presses against the inner wall of cup 10. The rim of head 18 includes a heating element 39 (shown in FIG. 5) which raises the temperature of head 18 to between 240° F. and 300° F. However, this will vary depending on the type of thermoplastic and should be sufficiently high to activate the adhesive, but not fuse the film to the cup. Membrane 34 is a thermoplastic including an adhesive. The heat from sealing head causes film 18 to be sealed against the inner wall of cup 10. If the sealing head is too hot, membrane 34 becomes fused to cup 10. Such a bond is difficult to remove and tears away the lamination of cup 10.

The rim of head 18 has a rounded edge. This rounded edge allows air trapped in cup 10 to escape while sealing head 18 moves downward into cup 10. This prevents excess air build-up within cup 10 which can cause membrane seal 34 to bulge or the seal to be broken.

Figure 4:
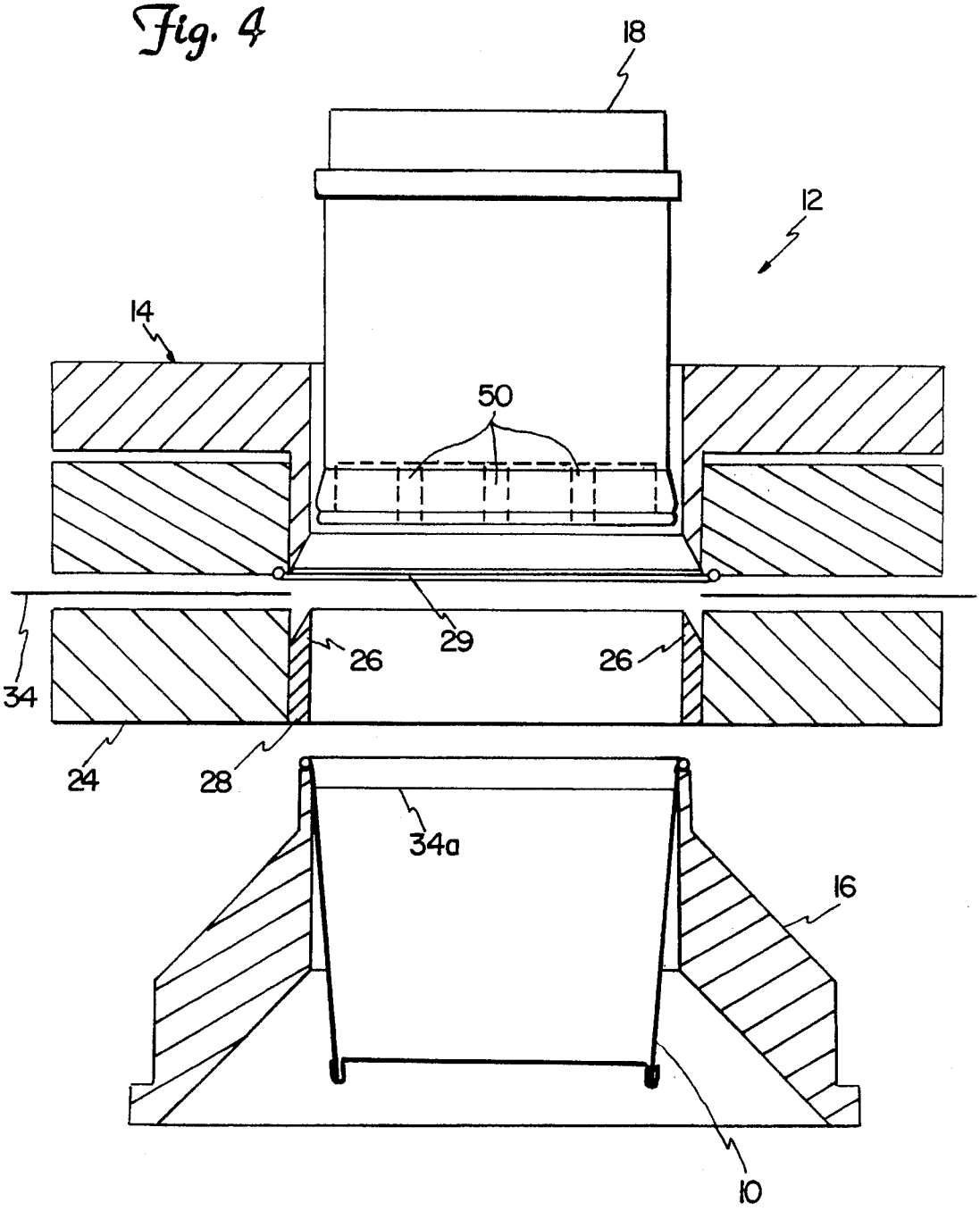
FIG. 4 is a cross-sectional view of the apparatus of FIG. 1 showing a subsequent step in the membrane application process.

FIG. 4 shows sealing head 18 after it is retracted from cup 10 by drive element 30. Sealed membrane 34*a* seals the top surface opening of cup 10. Sealing membrane 34*a* includes an outer lip which is sealed against the inner wall of cup 10. Drive elements 42 and 44 are shown retracted in FIG. 4 thereby separating upper membrane clamp 22 and lower membrane 24, freeing cut membrane film 34. In a subsequent step (not shown) rollers 36 and 38 rotate thereby moving membrane film 34 through applicator 14.

As sealing head 18 is retracted from cup 10, a vacuum may form between head 18 and sealed membrane 34*a*. Vent holes 50 in sealing head 18 are used to vent this vacuum. Additionally, if cup 10 sticks to sealing head 18 as sealing head 18 is retracted, retaining ring 28 holds cup 10 while sealing head 18 is extracted from cup 10. Cup 10 is then free to drop into holder 16.

In typical operation, the sealing process shown in steps 1–4 takes less than 0.4 seconds. This high speed also helps prevent membrane 34 from curling after it has been cut by upper knife 20 and holding ring 26. Typically, holder 16 moves on a conveyor system (not shown) which carries numerous cups 10 for sealing by applicator 14. This provides very high speed operation.

Figure 5:
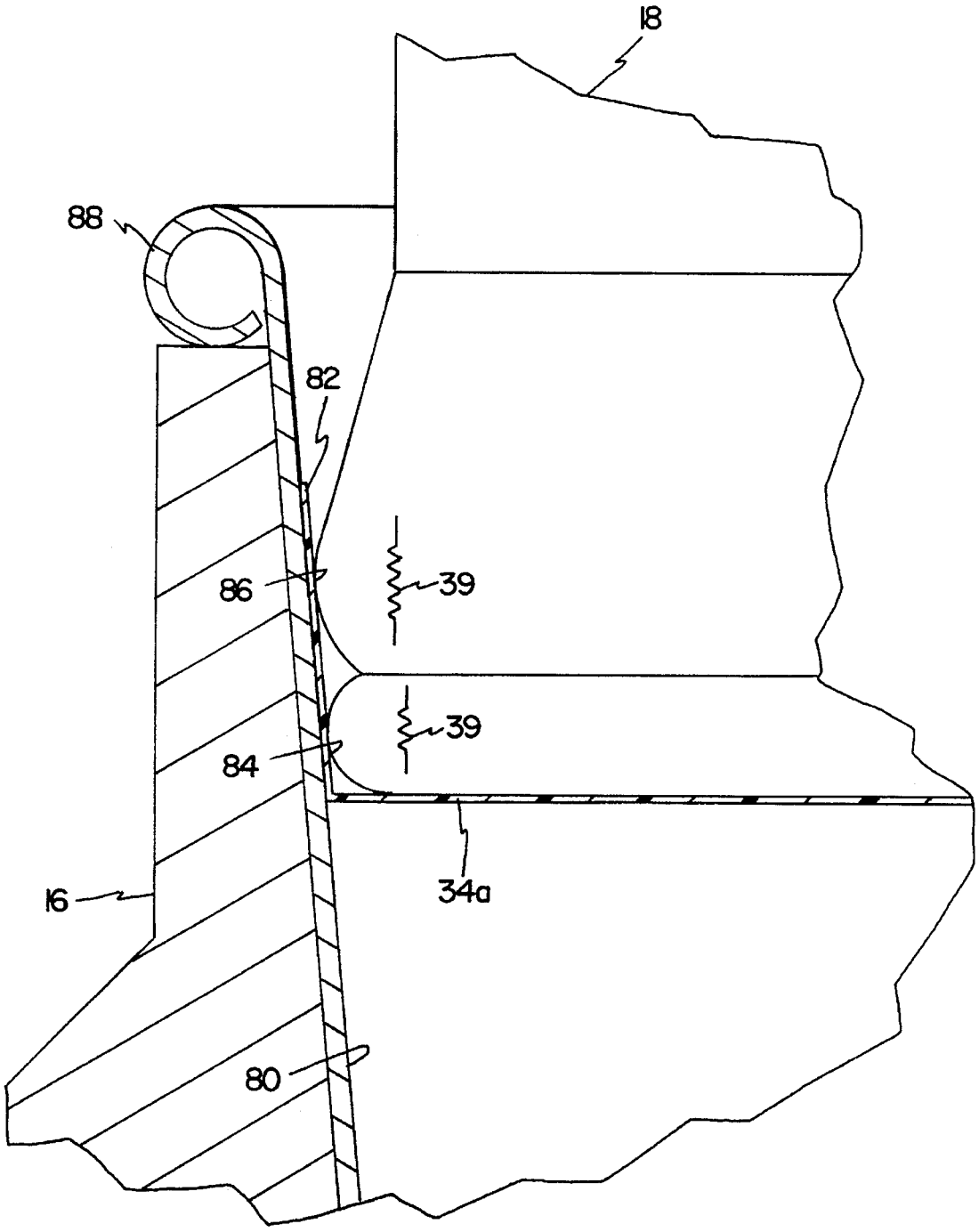
FIG. 5 is an enlarged cross-sectional view of the container and sealing head shown in FIG.

FIG. 5 shows a more detailed view of cup 10 and sealing head 18. Cup 10 includes inner wall 80 against which sealed membrane 34*a* is sealed. Membrane 34*a* includes an outer lip 82 which is sealed against inner wall 80. Sealing head 18 includes rim or lip 84 and rim or lip 86. Lips 84 and 86 provide two sealing points between membrane 34*a* and cup 10. Two sealing points provide a tight seal which is easily removed by a consumer. Both rims 84 and 86 are heated by heating elements 39 (shown as electrical resistors) to provide the seal. Cup 10 includes cup rim 88 which presses against retaining ring 28 when sealing head 18 is removed. Further, cup rim 88 is held by cup holder 16 while sealing head 18 is forced into cup 10.

The film membrane of the present invention is cheaper than cardboard or other types of preformed inserts used to seal cup 10. Further, the rounded edges of rims 84 and 86 allow the escape of trapped air from cup 10. The sealed membrane 34*a* is substantially leakproof and shows evidence of tampering should the seal be broken. The recessed seal provides head space which can be used for distribution of items with the food product. For example, the head space can be used to contain a spoon or a coupon. The double seal provides a hermetic seal while still being easily removed. Adhesive carried on membrane 34 forms a bead which flows due to the heat during the application process. The beading flows into any crevices in cup 10, such as the lip formed along the edge of a paper cup where the two halves of the paper are joined to form a cylinder.

Figure 6:
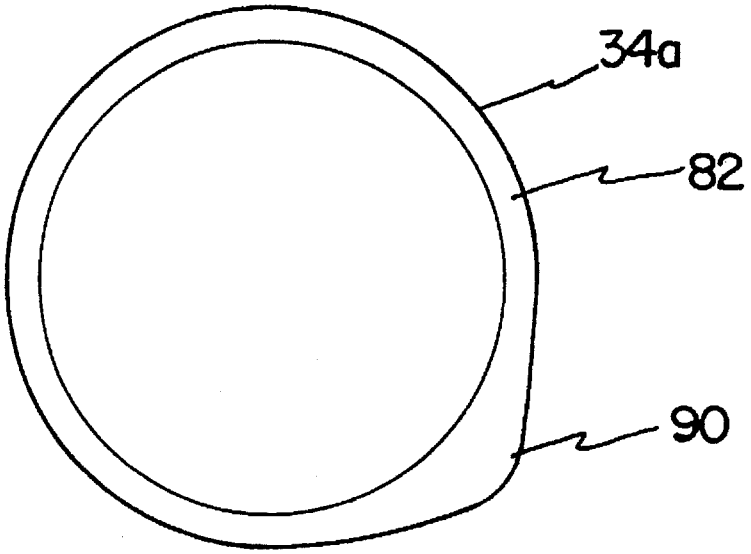
FIG. 6 is a top plan view of a cut membrane.

FIG. 6 shows a top plan view of a cut seal membrane 34*a* prior to insertion into cup 10. Membrane 34*a* includes an outer lip 82 and a tab 90. Outer lip 82 is folded upwards when membrane 34*a* is inserted into cup 10. This fold is formed when seal head 18 pushes membrane 34*a* through ring 28. Outer lip 82 is sealed against inner wall 80 of cup 10o Tab 90 is also folded upward and extends over rim 88 of cup 10. A consumer can remove membrane 34*a* from cup 10 by pulling on tab 92.

Figure 7:
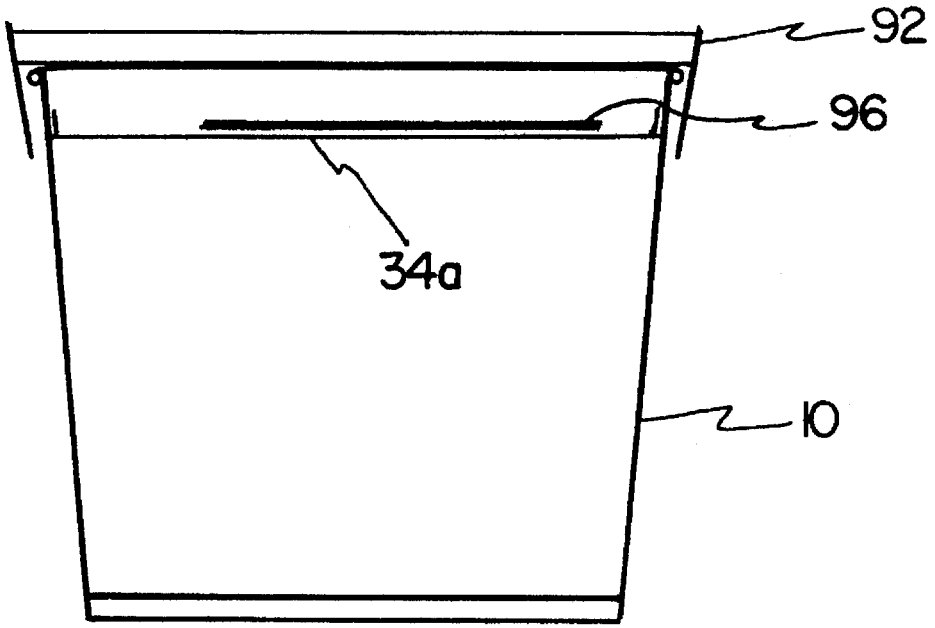
FIG. 7 is a cross-sectional view of a sealed container.

FIG. 7 shows membrane 34*a* after having been sealed to cup 10. Cover 92 can be placed over cup 10 to provide head space between cover 92 and membrane 34*a*. FIG. 7 shows item 96 carried in the space between cover 92 and membrane 34*a*. Item 96 is an item to be distributed with cup 10 such as a spoon, coupon or other item.

Although the present invention has been described with reference to preferred embodiments, workers skilled in the art will recognize that changes may be made in form and detail without departing from the spirit and scope of the invention. For example, holder 16 may comprise a receptacle in a rotary table of a rotary sealing machine or a linear conveyor in a straight line sealing machine.

What is claimed is:

1. An apparatus for applying a seal to a container comprising:

means for holding the container wherein an opening of the container is exposed;

a sealing head moveable in a linear direction between a withdrawn position and a sealing position in which the sealing head is positioned inside the container, the head aligned with the means for holding the container and of size to fit into the open end of the container in the sealing position, the sealing head including a first circumferential rim and a second circumferential rim;

means for moving a film membrane in a direction substantially perpendicular to the linear direction of the sealing head along a path positioned between the opening of the container and the withdrawn position of the sealing head;

a membrane holder positioned between the opening of the container and the withdrawn position of the sealing head, the membrane holder providing a cutting surface and having an opening defined therein substantially aligned with the sealing head along the linear direction and of size to allow passage of the sealing head therethrough;

a knife positioned between the opening of the container and the withdrawn position of the sealing head, the knife moveable in the linear direction between an open position and a cutting position in which the knife engages the cutting surface of the membrane holder thereby cutting the film membrane, the knife having an opening defined therein substantially aligned with the sealing head and the opening of the membrane holder along the linear direction and of size to allow passage of the sealing head therethrough;

means for moving the sealing head from the withdrawn position, through the membrane holder and the knife to the sealing position where the first rim seals the film membrane to the container along a first circumferential seal located inside the container and the second rim seals the film membrane to the container along a second circumferential seal located inside the container, the shape of the first and second rims allowing movement of air past the sealing head as the sealing head enters the container; and means for moving the knife to the cutting position prior to the sealing head moving to the sealing position, the knife thereby abutting the engaging surface of the membrane holder and cutting the film membrane.

2. The apparatus of claim 1 including: retaining means for holding the container while the sealing head is withdrawn from the container.

3. The apparatus of claim 1 wherein the knife has an outer perimeter which is greater than an outer circumference of the sealing head.

4. The apparatus of claim 3 where the membrane holder includes a retaining ring adjacent the opening of the container for forming a lip in the film membrane as the sealing head is passed through the retaining ring.

5. The apparatus of claim 4 wherein the outer perimeter of the knife cuts a tab in the film membrane which extends beyond the outer circumference of the sealing head adapted for grasping by a consumer to thereby break the first and second seals and remove the film membrane from the container.

6. The apparatus of claim 1 including:

an upper membrane clamp having an opening defined therein substantially aligned with the sealing head and of size to allow passage of the sealing head therethrough; and a lower membrane clamp having an opening defined therein substantially aligned with the sealing head and of size to allow passage of the sealing head therethrough, the upper and lower membrane clamps movable to clamp the membrane therebetween.

7. The apparatus of claim 6 including a gasket between the upper and lower membrane clamps to promote clamping of the membrane.

8. The apparatus of claim 1 including an air vent in the sealing head positioned within a circumference of the outer rim for providing an air passageway therethrough.

* * * * *